US012709370B2

(12) United States Patent
Gagnaire et al.

(10) Patent No.: US 12,709,370 B2
(45) Date of Patent: Aug. 18, 2026

(54) TETHERED-WING TRACTION SYSTEM INCLUDING FOLDING INTO A WINDSOCK

(71) Applicant: AIRSEAS, Nantes (FR)

(72) Inventors: Benoit Gagnaire, Nantes (FR); Jerome Rigaud, Coufouleux (FR)

(73) Assignee: KAWASAKI KISEN KAISHA LTD, Tokyo (JP)

( * ) Notice: Subject to any disclaimer, the term of this patent is extended or adjusted under 35 U.S.C. 154(b) by 415 days.

(21) Appl. No.: 18/549,908

(22) PCT Filed: Mar. 17, 2022

(86) PCT No.: PCT/EP2022/057070
§ 371 (c)(1),
(2) Date: Sep. 9, 2023

(87) PCT Pub. No.: WO2022/195046
PCT Pub. Date: Sep. 22, 2022

(65) Prior Publication Data

US 2024/0166320 A1 May 23, 2024

(30) Foreign Application Priority Data

Mar. 19, 2021 (FR) ..... FR2102789

(51) Int. Cl.
*B63H 9/072* (2020.01)
*B63B 35/00* (2020.01)

(52) U.S. Cl.
CPC ..... *B63H 9/072* (2020.02); *B63B 2035/009* (2013.01)

(58) Field of Classification Search
CPC .... B63H 9/072; B63H 9/069; B63B 2035/009
See application file for complete search history.

(56) References Cited

U.S. PATENT DOCUMENTS 11,225,311 B2 * 1/2022 Arrouy ..... B63H 9/1021
11,479,331 B2 * 10/2022 Arrouy ..... B63H 9/10
(Continued)

FOREIGN PATENT DOCUMENTS

FR 3082184 12/2019
WO WO2017085501 5/2017

OTHER PUBLICATIONS

Machine translation of Arrouy et al. (WO Pub No. 2019/239045 A1) Pub date Dec. 19, 2019 (Year: 2019).*
(Continued)

*Primary Examiner* — Rodney A Bonnette
(74) *Attorney, Agent, or Firm* — Defillo & Associates, Inc; Evelyn A. Defillo

(57) ABSTRACT

A process for deployment of a tethered-wing traction system, including a step of flight of a traction wing (5) relative to a stowing mast (4), and including, before the flight step, a step of windsock folding of the traction wing (5), wherein: the median area (15) of the leading edge (16) is retained relative to the stowing mast (4) at a first height on the stowing mast (4); the lateral portions (19) of the leading edge (16) are retained relative to the stowing mast (4) at a second height at least on the stowing mast (4), which is lower than the first height, the leading edge (16) forming a windsock air inlet with a circular opening; the leading edge (16) forming a windsock air inlet with a circular opening; the trailing edge (17) is reclosed by bringing the lateral portions (19) of the trailing edge (17) towards one another.

14 Claims, 9 Drawing Sheets

(56) References Cited

U.S. PATENT DOCUMENTS

| | | | | |
|---|---|---|---|---|
| 2009/0266283 | A1 | 10/2009 | Wrage | |
| 2024/0149997 | A1* | 5/2024 | Verfaillie | B63H 9/072 |
| 2024/0166321 | A1* | 5/2024 | Jan | B63H 9/072 |
| 2024/0166322 | A1* | 5/2024 | Verfaillie | B63H 9/072 |

OTHER PUBLICATIONS

Machine translation of Abstract of Arrouy et al. (FR Pub No. 3,082,184 A1) Pub date Dec. 13, 2019 (Year: 2019).*

* cited by examiner

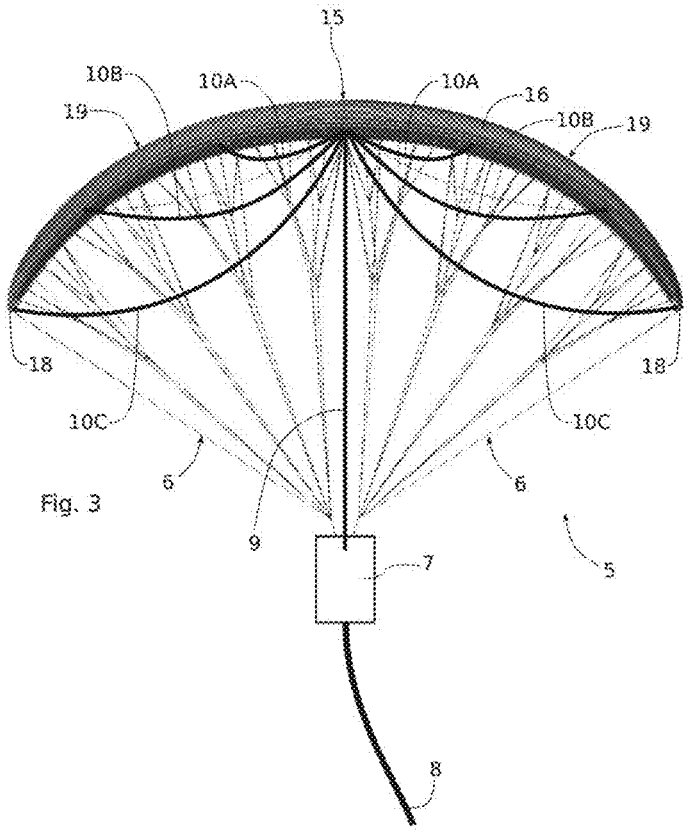
Fig. 3
Fig. 4
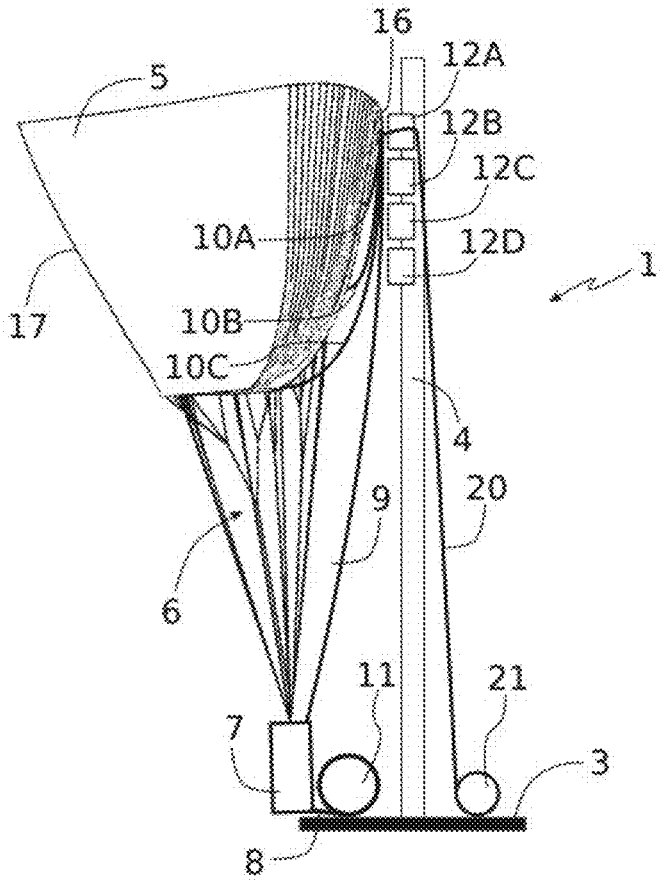

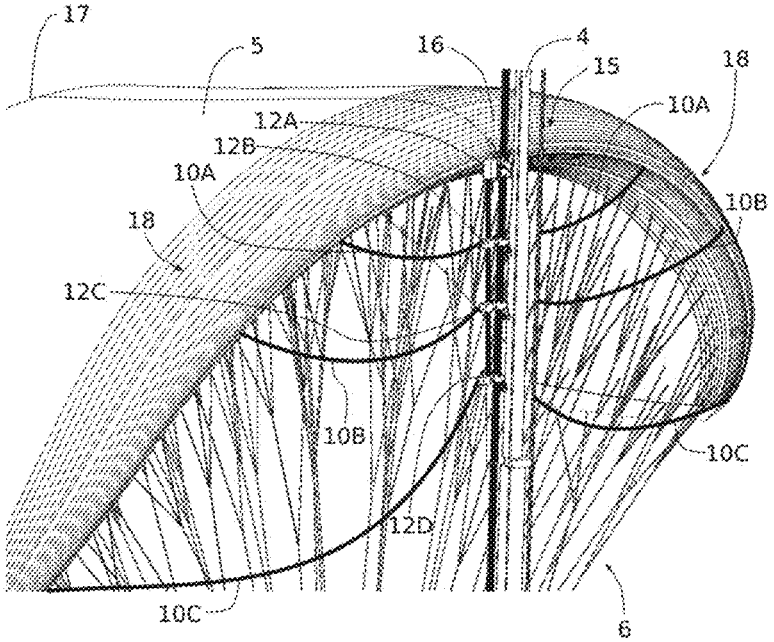
Fig. 15
Fig. 16
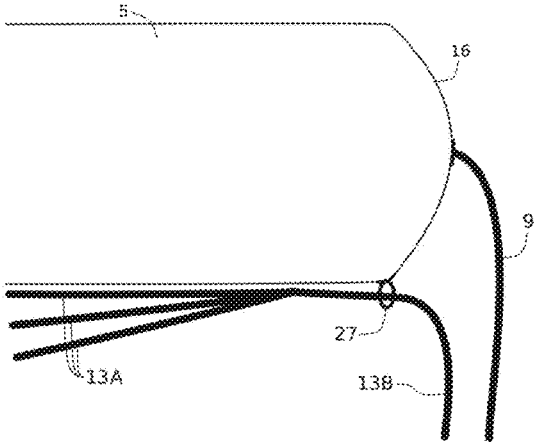
Fig. 17
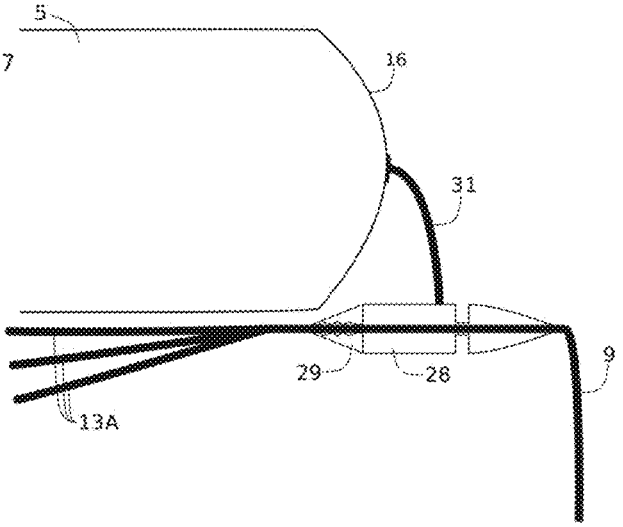

TETHERED-WING TRACTION SYSTEM INCLUDING FOLDING INTO A WINDSOCK

CROSS REFERENCE TO RELATED APPLICATION

This application is a national stage entry of PCT/EP2022/057070 filed Mar. 17, 2022, under the International Convention and claiming priority over French Patent Application No. FR2102789 filed Mar. 19, 2021.

TECHNICAL FIELD

The invention relates to the field of tethered-wing traction systems which are designed to deploy and refold a traction wing relative to a base platform, this traction wing being designed to generate a traction force under the effect of the wind.

Traction systems of this type permit deployment of a flying traction wing which is used for propulsion of a vehicle, in particular a ship (as the main or auxiliary propulsion system), for production of electricity, or any application which benefits from a traction force of this type.

PRIOR ART

French patent application FR3082184 describes a tethered-wing traction system, and a process for deployment and refolding of the traction wing. The traction wing comprises folding lines which are secured to its leading edge, and the system comprises means for pulling at least three folding lines in order to return the leading edge against the mast at two different heights at least along this mast.

This traction system benefits from a deployment and refolding process which is more efficient and more secure.

SUMMARY OF THE INVENTION

The objective of the invention is to improve the tethered-wing traction systems according to the prior art, as well as the associated deployment processes.

For this purpose, the subject of the invention is a process for deployment of a tethered-wing traction system, comprising a traction wing which is designed to generate a traction force under the effect of the wind, and is designed to be deployed and refolded relative to a base platform which is provided with a stowing mast, the traction wing having: a trailing edge which comprises two lateral portions; and a leading edge which comprises a median area and two lateral portions; this process comprising a step of making the traction wing fly relative to the stowing mast, as well as a windsock folding step of the traction wing, before the flight step.

In this step of windsock folding of the traction wing:

- the median area of the leading edge is retained relative to the stowing mast at a first height on the stowing mast;
- the lateral portions of the leading edge are retained relative to the stowing mast at a second height at least on the stowing mast, which is lower than said first height;
- the trailing edge is reclosed by bringing the lateral portions of the trailing edge towards one another.

According to another objective, the subject of the invention is a tethered-wing traction system comprising:

- a traction wing which is designed to generate a traction force under the effect of the wind, and is designed to be deployed and refolded relative to a base platform which is provided with a stowing mast, the traction wing having: a trailing edge which comprises two lateral portions; and a leading edge which comprises a median area and two lateral portions;
- a plurality of folding lines each having a free end secured to the leading edge, while being spaced from each other along this leading edge.

This traction system additionally comprises:

- a line which is connected to the median area of the leading edge;
- at least one closure line which is connected to the trailing edge;
- a control unit designed to control traction on the line which is connected to the median area, the folding lines, and the closure line, this control unit comprising a windsock folding mode wherein: the median area of the leading edge is retained relative to the stowing mast at a first height on the stowing mast, by traction of the line which is connected to the median area; the lateral portions of the leading edge are retained relative to the stowing mast at a second height at least on the stowing mast, which is lower than said first height, by traction of the folding lines; the trailing edge is reclosed by mutual movement of the lateral portions towards the trailing edge, under the effect of traction of the closure line.

A traction system of this type and a deployment process of this type make it possible to go through an intermediate windsock folding phase of the traction wing.

In this case, this windsock folding step designates specifically a form of the traction wing specific to the invention, wherein the leading edge forms an air inlet, whereas the trailing edge is closed sufficiently for the traction wing thus folded in the form of a windsock to act as a pocket which can be filled with air.

In this windsock folding configuration, the traction wing is similar to a windsock with a circular opening and a convergent tube effect which tends to stabilize the kite.

This geometric configuration, which can advantageously be controlled dynamically by acting jointly on the guide line, on the folding lines and the closure lines, makes it possible to stabilize the traction wing and avoid any deflation just before the flight of the traction wing.

This step of windsock folding also makes it possible to inflate the traction wing and provide it with power, just before its flight, such that the flight takes place without a phase of uncertainty where the traction wing could lose its trajectory or its lift.

The deployment process according to the invention can comprise the following additional characteristics, taken alone or in combination:

- the retention relative to the stowing mast of the median area of the leading edge is provided by traction of a line which is connected to the median area of the leading edge;
- the retention relative to the stowing mast of the lateral portions of the leading edge is provided by traction of folding lines which each have an end secured to the leading edge, while being spaced from one another along this leading edge;
- the folding lines are positioned in symmetrical pairs, with each folding line of a pair connecting the median area of the leading edge to another area of the leading edge, and the traction of the folding lines is provided by pulling jointly on the two lines of each pair of folding lines;

the retention relative to the stowing mast of the lateral portions of the leading edge is provided by traction of at least three pairs of symmetrical folding lines, following at least three heights along the stowing mast;

the closure of the trailing edge is carried out by traction of at least one closure line connected to the trailing edge;

during the windsock folding step, the closure line is grasped by a first carriage sliding along the stowing mast;

during the windsock folding step, the folding lines are each grasped in a sliding manner by a carriage situated below the first carriage;

said line which is connected to the median area of the leading edge is connected to the median area by a clamping means, and is connected to the closure line, with the windsock folding step comprising an operation of release or traction of the closure line, this operation comprising the following tasks: opening of the clamping means; release or traction of said line which is connected to the median area of the leading edge, giving rise to release or traction on the closure line; closure of the clamping means.

The traction system according to the invention can comprise the following additional characteristics, taken alone or in combination:

the folding lines are positioned in symmetrical pairs, with each folding line of a pair connecting the median area of the leading edge to another area of the leading edge, and the traction of the folding lines is provided by pulling jointly on the two lines of each pair of folding lines;

the system comprises carriages which slide along the stowing mast and are designed to grasp in a sliding manner the line which is connected to the median area and the folding lines, these carriages being spaced from one another along the stowing mast when the control unit is in the windsock folding mode;

the line which is connected to the median area is connected to the median area by a clamping means, and is connected to the closure line, with the control unit being designed to control the clamping means such that, when it is in its windsock folding mode, the control unit is designed to, in succession: open the clamping means; release or pull the line which is connected to the median area, while giving rise to release or traction on the closure line; close the clamping means;

the closure line moves along the trailing edge while passing into rings;

the closure line connects the two lateral portions of the trailing edge;

the closure line forms a loop between two rings each positioned on a lateral portion of the trailing edge.

BRIEF DESCRIPTION OF THE DRAWINGS

Other characteristics and advantages of the invention will become apparent from the following non-limiting description, provided with reference to the appended drawings, in which:

FIG. 3 represents the traction wing of the system of FIG. 1, seen from the front;

FIG. 4 illustrates a step of refolding of the system of FIG. 1;

FIG. 15 represents in perspective the traction wing of FIG. 14;

FIG. 16 illustrates a variant embodiment of the traction system;

FIG. 17 illustrates another variant embodiment of the traction system;

Elements which are similar and common to the different embodiments bear the same reference numbers in the figures.

DETAILED DESCRIPTION OF THE INVENTION

Figure 1:
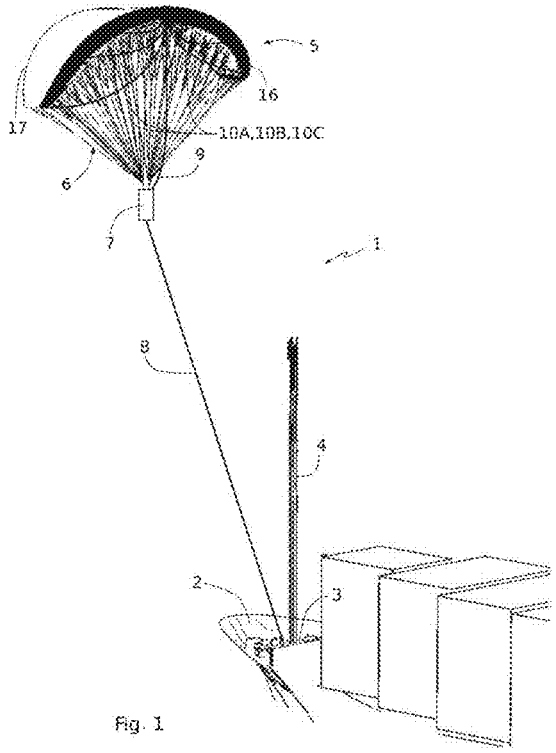
FIG. 1 represents in perspective a ship propelled by a tethered-wing traction system according to the invention.

FIG. 1 illustrates a tethered-wing traction system 1, fitted on a ship 2, which, in this example, is an ocean freight ship (in FIG. 1, only the front of the ship is represented).

In the present example, the traction system 1 is fitted on the prow of the ship 2, and is actuated as a complementary propulsion means of the ship, allowing fuel to be saved. In this context, the traction system 1 has dimensions according to the tonnage of the ship to be towed, and is designed to be deployed and refolded automatically.

As a variant, this traction system 1 can be used for any other application where a traction system of this type which can be deployed and refolded automatically is required, for example as the main propulsion means of a ship, for the propulsion of any other vehicle, for the production of electricity, etc.

The traction system 1 comprises a base platform 3, which in this case is secured on the deck of the ship 2, and on which there is fitted a stowing mast 4 which is designed for the operations of automatic deployment and refolding of the system.

The traction system 1 also comprises a traction wing 5, which is designed to generate a traction force under the effect of the wind. In the present example, the traction wing 5 is a sail of the paraglider type. As an alternative, any other flying equipment designed to generate a traction force under the effect of the wind can be used, such as kites, gliding equipment, sails of the kite type, etc. The traction wing 5 conventionally comprises a leading edge 16 which is designed to be exposed to the incident wind, and an opposite edge, known as the trailing edge 17.

The traction wing 5 is connected by a set of suspension lines 6 to a flying trajectory control device 7 which is designed to act on the suspension lines 6 in order to control the flight of the traction wing 5.

The traction system 1 additionally comprises a traction line 8 which connects the flying trajectory control device 7 to the base platform 3. The traction force which is generated by the traction wing 5 is transmitted by the traction line 8 to the ship 2 for the propulsion thereof, and the traction line has appropriate dimensions for this purpose. Within the context of traction of an ocean freight ship, the traction line can for example be a textile cable, the diameter of which can be as much as several centimeters.

The flying trajectory control device 7 makes it possible to control the flight of the traction wing 5, in order to orient and position the traction wing, and optionally to make the traction wing 5 describe flight figures which make it possible to increase the traction force on the ship. In this case, the control of the trajectory of the traction wing 5 is obtained by controlling the length of certain mobile suspension lines, in a conventional manner in the field of flying kites. In fact, the set of suspension lines 6 comprises fixed suspension lines (i.e. which have a fixed length between their attachment to the traction wing 5 and their attachment to the flying trajectory control device 7), and mobile suspension lines, the length of which is variable. The flying trajectory control device 7 is thus designed to pull on certain mobile suspension lines, and/or to release other mobile suspension lines, such that the aerodynamic profile of the traction wing 5 is modified for the purpose of controlling its lift, its trajectory, etc. The modification of the profile of a traction wing in order to control its trajectory is carried out in a conventional manner, and will not be described in greater detail here.

The traction wing 5 additionally comprises a guide line 9, and a plurality of folding lines 10A, 10B, 10C, which are all integral with the leading edge 16 at one of their ends at least.

Figure 2:
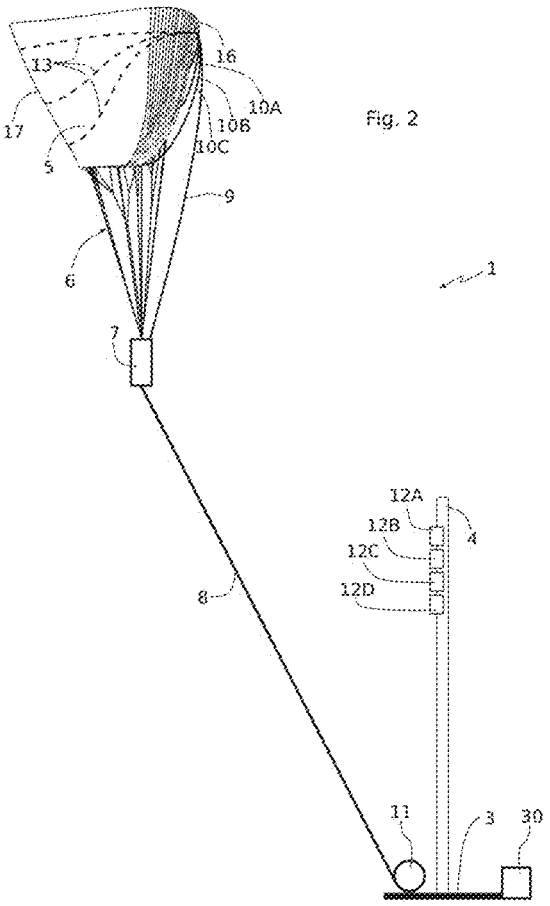
FIG. 2 illustrates schematically the elements of FIG. 1, seen in profile.

FIG. 2 is a view in profile of the traction system 1 in the phase of traction of the ship, as in FIG. 1. In addition, FIG. 2 illustrates schematically component elements of the traction system 1.

The traction line 8 is connected to the base platform 3 by means of a winch 11 controlled by a motor, which for example is electric or hydraulic, and is designed to unwind the traction line 8 in order to allow the traction wing 5 to gain height, or, on the other hand, to wind this traction line 8 in order to bring the traction wing 5 towards the base platform 3.

FIGS. 1 and 2 illustrate the traction system 1 in a traction configuration, with the traction wing 5 being deployed and in flight, and the system participating in the propulsion of the ship.

In addition, the traction system 1 comprises carriages 12A, 12B, 12C, 12D, of which there are four in the present example. These carriages are secured in a sliding manner on the stowing mast 4, and are each motorized, such that the position of each carriage along the stowing mast 4 can be controlled. These carriages are designed to grasp and guide the guide line 9, optionally by means of a stowing line or an intermediate part, and the folding lines 10A,10B,10C during the phases of deployment or refolding described hereinafter.

The traction wing 5 additionally comprises closure lines 13, which make it possible to reclose the trailing edge 17. These closure lines 13 extend transversely to the traction wing 5, and one of their ends is secured on the trailing edge 17, whereas the other end is positioned in the vicinity of the leading edge 16. The closure lines, which are represented in broken lines in FIG. 2, preferably move on the underneath of the traction wing 5, and, as a variant, can move on the top or through the interior of the traction wing 5.

The closure lines 13 can be grasped or maneuvered from an area in the vicinity of the leading edge 16, such that traction on these closure lines 13 gives rise to traction on one or more portions of the trailing edge 17.

In the present example, the different closure lines 13 are grouped into one or more main lines which project from the leading edge 16.

The closure lines are preferably grasped by an appropriate device of the stowing mast 4.

Each carriage 12A, 12B, 12C, 12D has automatic or manual fastening means which make it possible to grasp certain lines selectively.

The traction system 1 additionally comprises a control unit 30 which is constituted by conventional electronic means for the command and control of the different actuators of the system. In this case, in particular, the command unit 30 controls the position and movement of the motorized carriages 12A, 12B, 12C, 12D, the action of the winch 11, and any other actuator which participates in the operation of the system, as well as an optional hydraulic unit and the associated actuators.

FIG. 3 illustrates the traction wing 5 alone, in its position of FIGS. 1 and 2, seen from the front. In particular, this FIG. 3 shows: the set of suspension lines 6 connecting the traction wing 5 to the flying trajectory control device 7; the guide line 9, and the folding lines 10A, 10B, 10C.

In the present example, the folding lines are distributed in three pairs of folding lines which connect symmetrically a median portion 15 of the leading edge 16 to other points regularly distributed on the leading edge 16. In fact, the leading edge 16 comprises:

- a median area 15, which is situated substantially in the middle of the leading edge 16, i.e. substantially at an equal distance, on this leading edge 16, between the two lateral ends 18 of the traction wing 5;
- two lateral portions each situated between the median area 15 and one of the lateral ends 18.

The folding lines 10A, 10B, 10C are thus secured on the leading edge 16, while being spaced from one another along this leading edge.

The guide line 9 for its part connects the median area 15 to the flying trajectory control device 7. Optionally, the guide line 9 is connected to the traction wing 5 by an intermediate part.

The closure lines 13 are also accessible from the median area 15 of the leading edge 16, either directly, or by being connected to the guide line 9 (see the examples given with reference to FIGS. 16 and 17).

Thus, all of the lines 9, 10A, 10B, 10C, and 13 are accessible or can be actuated from the median area 15 of the leading edge 16.

The traction system 1 is designed to be refolded and deployed automatically. The process for refolding of the traction system 1 from its traction position in FIGS. 1 and 2 will now be described with reference to FIGS. 4 to 8.

Starting from the positions in FIGS. 1 and 2 in which the traction wing 5 is in the flight phase, the refolding process is initiated by actuating the winch 11 in order to bring the traction wing 5 onto the base platform 3, as illustrated in FIG. 4. This step immobilizes the flying trajectory control device 7 on the base platform 3, for example on an appropriate support (not represented), whereas the traction wing 5 continues to be inflated by the wind. This step thus preferably takes place by orienting the stowing mast 4, and thus the traction wing 5, facing the wind, such that the direction of the wind is perpendicular to the leading edge 16.

Starting from this position in FIG. 4, a plurality of lines are grasped by the carriages 12A, 12B, 12C, 12D. Each carriage comprises for example fastening means, such as hooks or clasps, making it possible to clamp a line in a sliding manner. These fastening means are preferably put into place on the lines automatically, by an actuator controlled by the control unit 30, but they can also be put into place manually. The translation of the carriages 12A, 12B, 12C, 12D can also be used to actuate the lines grasped by exerting traction on some lines thanks to a movement of spacing between two carriages.

In the present example, the lines are grasped by the carriages as follows:

- the guide line 9 is grasped by the first carriage 12A, directly or indirectly;
- the first pair of folding lines 10A is grasped by the second carriage 12B, i.e. the carriage 12B clamps the two lines 10A together in a sliding manner;
- the second pair of folding lines 10B is grasped by the third carriage 12C;
- the third pair of folding lines 10C is grasped by the fourth carriage 12D.

According to a variant illustrated in FIG. 4, the carriage 12A clasps the guide line 9 by means of a stowing line 20, which is obtained from a winch 21 also controlled by the control unit 30, and which passes via a pulley or a ring of the carriage 12A, and the end of which is fastened in a sliding manner on the guide line 9.

The fastening of the stowing line 20 on the guide line 9, and the traction exerted by the winch 21, make it possible to immobilize the traction wing 5, by retaining the median area 15 of its leading edge 16 against the carriage 12A, and thus against the stowing mast 4.

Similarly, the other carriages 12B, 12C, 12D each grasp their pair of folding lines 10A, 10B, 10C at the median area 15, where the folding lines of each symmetrical pair meet.

Figure 5:
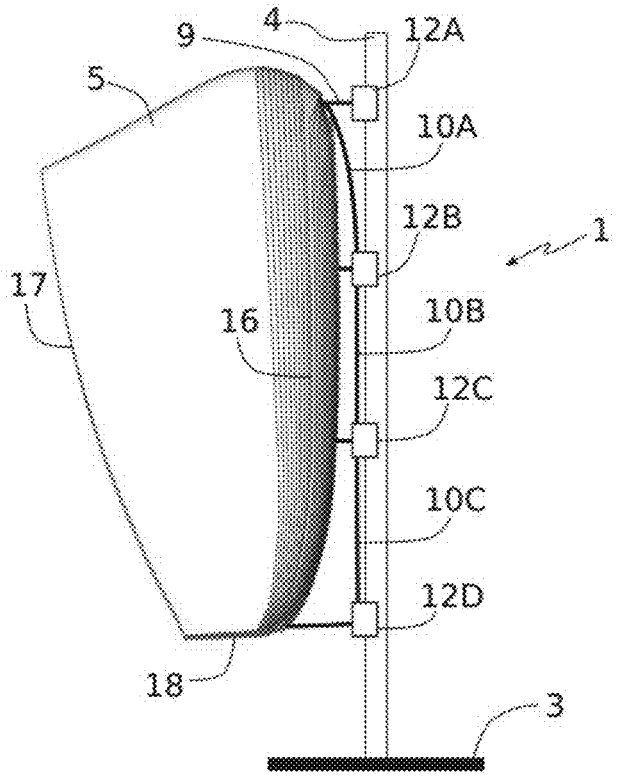
FIG. 5 illustrates another step of refolding of the system of FIG. 1.

Starting from the position in FIG. 4, and after the lines 9, 10A, 10B, 10C have been grasped, the carriages 12B, 12C, 12D which clamp the folding lines then descend along the mast 4. During their descent, the carriages 12B, 12C, 12D slide along the folding lines, drawing each of the lines vertically from the median area 15, and thus bringing the lateral portions 19 towards the mast 4, until folding in two of the traction wing 5 is obtained. FIG. 5 illustrates an intermediate step of this descent of the carriages to the folding position, which is represented in perspective in FIG. 6. In this position, the lateral portions 19 of the leading edge 16 are facing one another. In this folding position in FIG. 6, the traction wing 5 can be stowed by any means which allow it to be compressed in the direction 23 and/or in the direction 24. This stowing can be carried out by traction on dedicated stowing lines, or alternatively on the closure lines 13. This traction on the closure lines 13 can be carried out for example by traction of the guide line 9 (which can be connected to the closure lines 13), and/or by stowing carriages, not represented.

The traction wing 5 thus stowed is ready to be stored.

The schematic FIG. 5 onwards simply illustrate the main elements showing the cooperation of the carriages and the traction wing 5, with the other elements such as the trajectory control device 7 or the suspension units 6 not being represented in order to simplify the figures.

Figure 6:
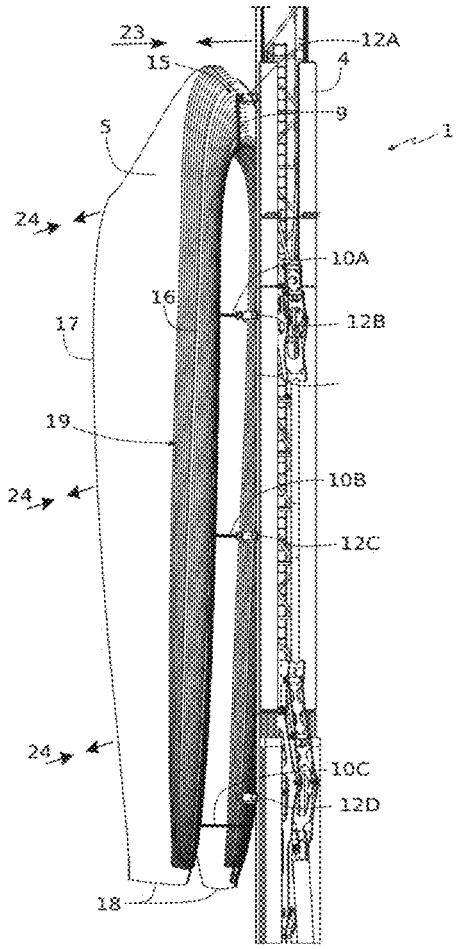
FIG. 6 illustrates the traction wing in the folded position along the stowing mast.
Figure 7:
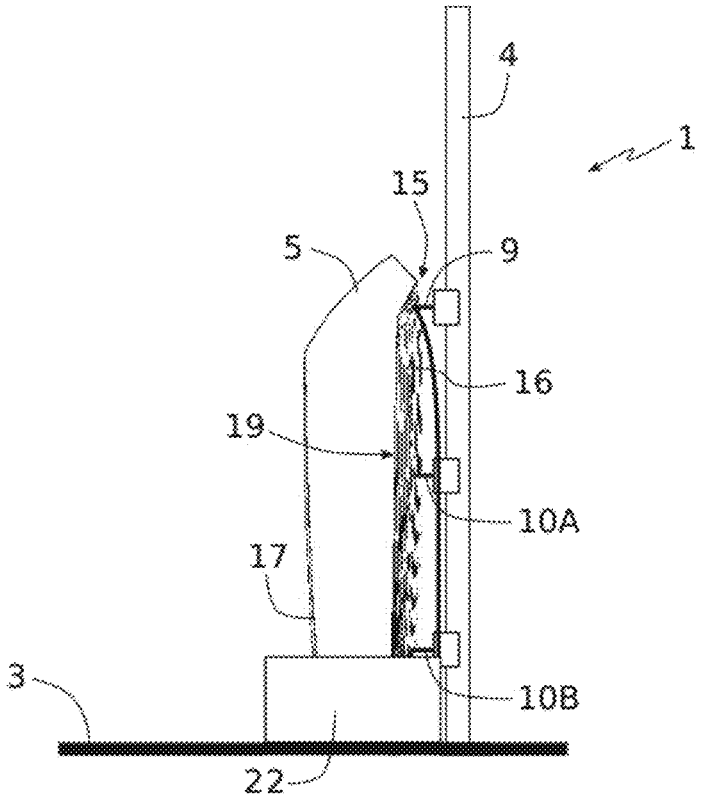
FIG. 7 illustrates a step of storage of the traction wing.
Figure 8:
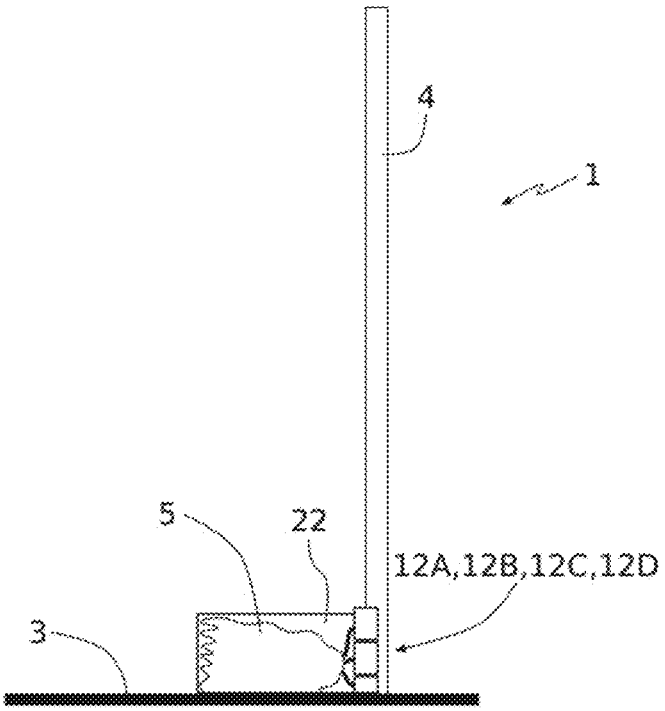
FIG. 8 illustrates another step of storage of the traction wing.

Starting from this position in FIGS. 6 and 7, and with reference to FIGS. 7 and 8, the four carriages 12A, 12B, 12C, 12D then descend by sliding along the stowing mast 4, in order to store the traction wing 5 in a receptacle 22. This descent of the carriages is carried out by maintaining mutual spacing between them, which permits maintenance of traction on the folding lines 10A, 10B,10C. The traction wing 5 has thus descended along the mast until it is stored in the receptacle 22.

FIG. 8 illustrates the traction system 1 in the refolded position, with the traction wing 5 being positioned entirely in the interior of the receptacle 22.

Starting from this refolded position in FIG. 8, the process for deployment of the traction system 1 will now be described. The steps of the deployment process are initiated from the refolded position in FIG. 8, and take place in the inverse order to the refolding steps previously described.

The carriages 12A, 12B, 12C, 12D are firstly raised by sliding along the stowing mast 4, going via a position corresponding to that of FIG. 7, as far as the folding position of FIG. 6, in which the traction wing 5 is retained folded along the stowing mast 4, with the median area 15 of the leading edge 16 retained against the stowing mast 4.

Figure 9:
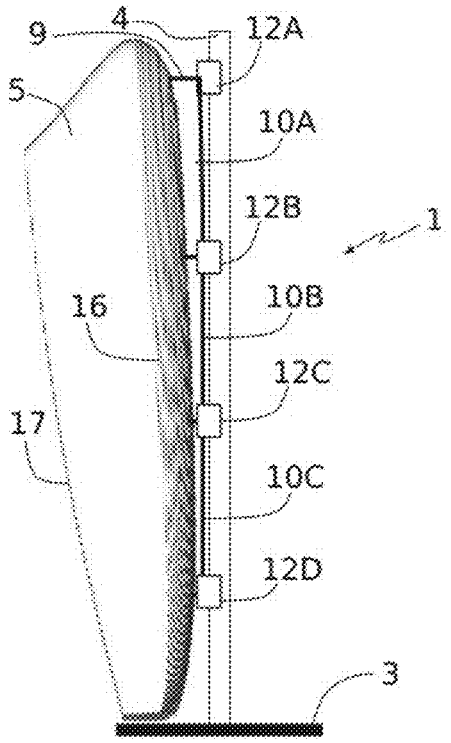
FIG. 9 illustrates a step of deployment of the traction wing.
Figure 10:
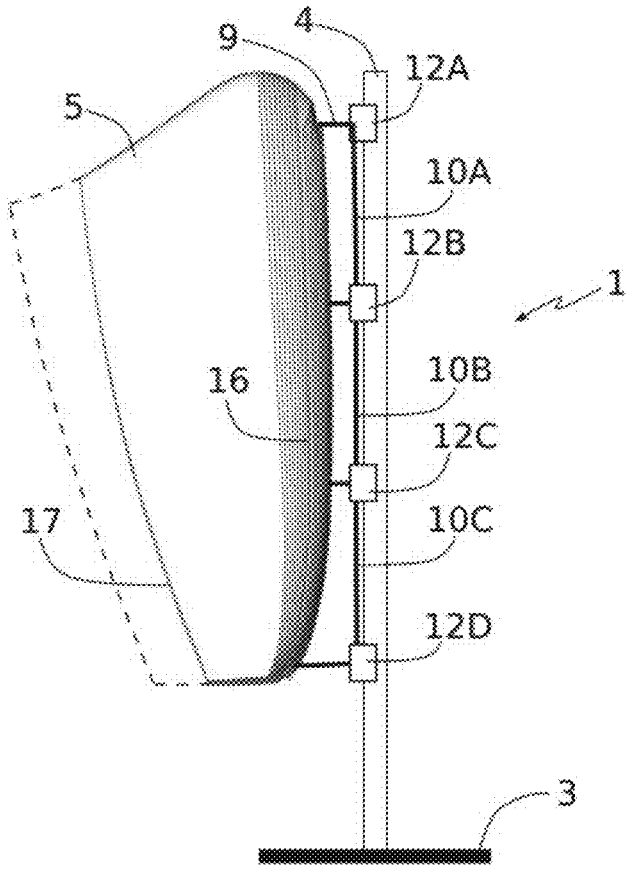
FIG. 10 illustrates another step of the deployment of the traction wing.

This folding position in FIG. 6 is also represented in profile view in FIG. 9. In this position, the traction wing 5 is still stowed by maintenance of traction on stowing lines and/or on the closure lines 13. The traction wing 5 then goes to a windsock folding step. The stowing of the traction wing 5 is released, then a certain tension is exerted on the closure lines 13. FIG. 10 illustrates schematically (with a maximal rear rim represented in broken lines) this phase where the stowing of the traction wing 5 is released, while the trailing edge 17 is reclosed by the action of the closure lines 13.

Figure 11:
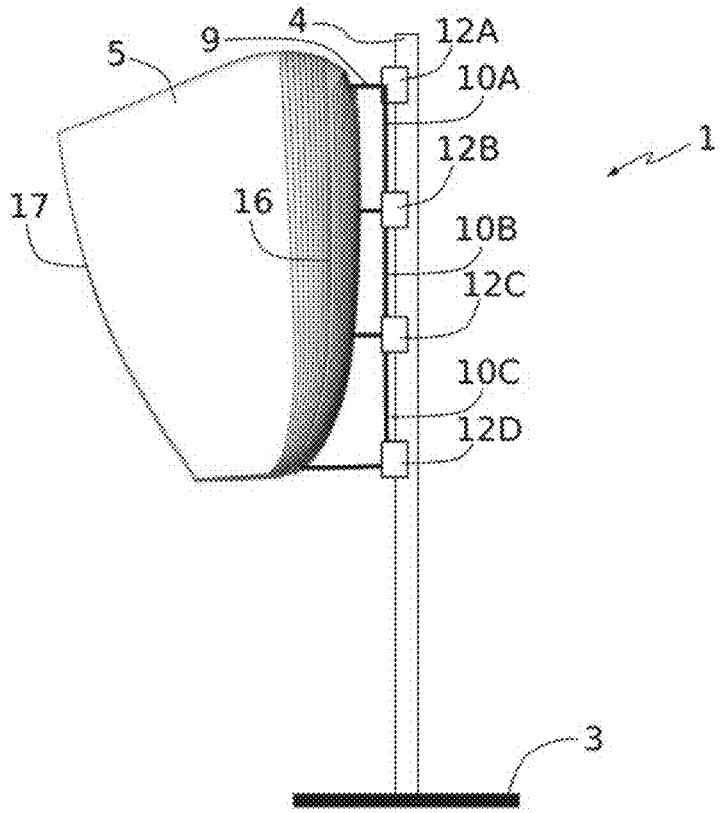
FIG. 11 illustrates a step of windsock folding of the traction wing.
Figure 12:
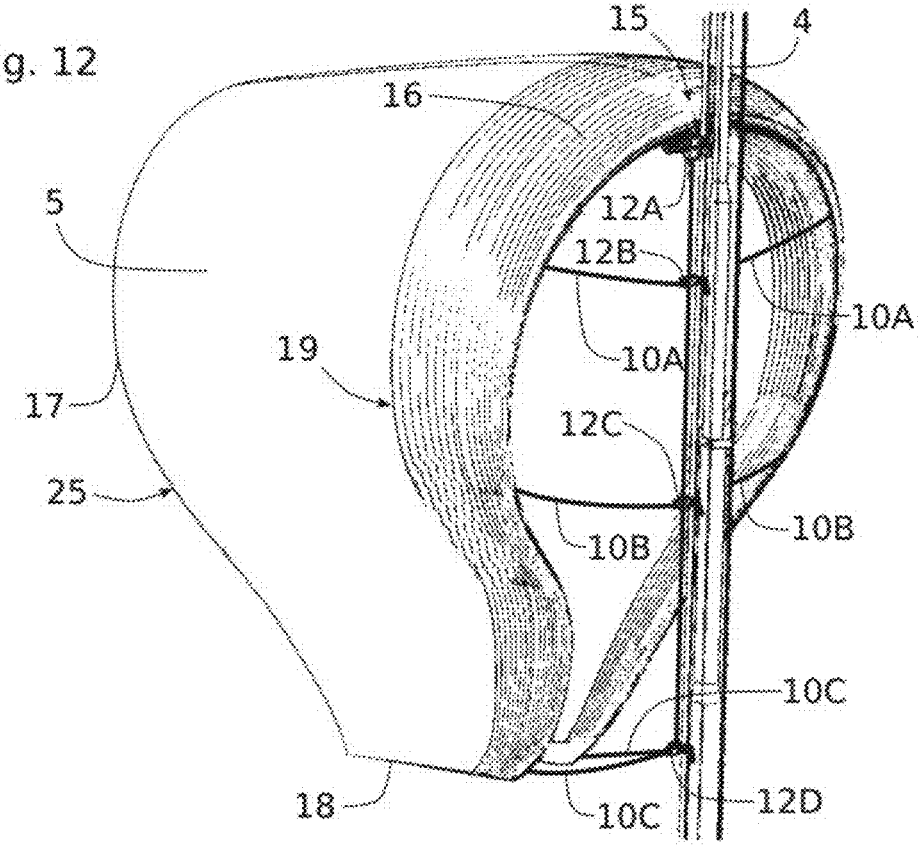
FIG. 12 represents in perspective the traction wing of FIG. 11.
Figure 13:
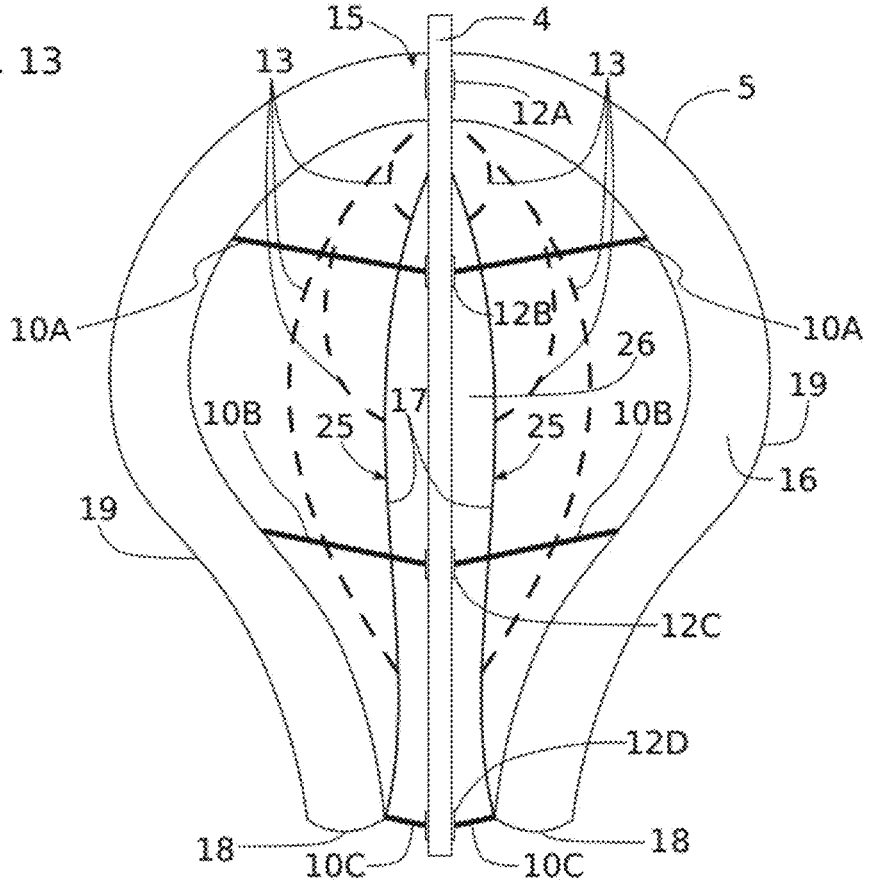
FIG. 13 represents the traction wing of FIG. 11, seen from the front.

The carriages 12B, 12C, 12D are then raised along the stowing mast 4 as far as the windsock folding position illustrated in FIGS. 11 to 13. In this windsock folding position:

- the folding lines 10A, 10B, 10C are partly released, and the traction wing 5 is thus partly open;
- the closure lines 13 are partly released.

This windsock folding step is illustrated in profile view in FIG. 11, in perspective in FIG. 12, and in front view in FIG. 13.

As for the leading edge 16, the trailing edge 17 comprises two lateral portions 25 which face one another when the traction wing 5 is in the refolded position. During the windsock folding step, the trailing edge 17 is reclosed by mutual movement of the lateral portions 25 towards the trailing edge 17. The concept of closure of the trailing edge refers to partial bringing towards one another of the lateral portions 25, such that the base of the receptacle created by the traction wing 5, thus folded in the form of a windsock, is partly closed. The traction wing 5 thus forms a receptacle which is inflated by air (with the traction wing facing the wind). The lateral portions 19 of the leading edge 16 form an opening for this receptacle.

The control unit 30 comprises a windsock folding mode in which:

- the median area 15 of the leading edge 16 is retained relative to the stowing mast 4 at a first height on the stowing mast (that of the carriage 12A), by traction of the guide line 9;
- the lateral portions 19 of the leading edge 16 are retained relative to the stowing mast 4 by traction of the folding lines 10A, 10B, 10C, at three different heights on the stowing mast 4, corresponding to the heights of the carriages 12B, 12C, 12D, these heights being lower than said first height;

the trailing edge 17 is reclosed by bringing the lateral portions 25 of the trailing edge towards one another, by traction of the closure lines 13.

The windsock folding of the traction wing 5 corresponds to forming thereof which allows it a certain stable exposure to the wind.

As represented in the view from the front in FIG. 13, the partial traction on the closure lines 13 gives rise to bringing of the lateral portions 25 towards one another, such that only a single interstitial opening 26 is present in the base of the receptacle formed by the traction wing 5 thus folded in the form of a windsock.

The traction wing 5 benefits from stable inflation and retention even in unfavorable conditions, such as a wind which is dropping. The windsock folding of the traction wing 5 makes it possible to take advantage of the form of the traction wing 5, and thus its resulting drag and lift, in order to assist the stabilization, opening, and unfolding of the traction wing 5. The traction wing 5 is thus placed in a position favorable for its deployment. In fact, it is during the deployment of the traction wing 5 that the disturbances of the incident wind are liable to disturb, or even prevent the deployment of the traction wing 5. This process of deployment of the traction wing 5 can thus be automated without risks to be feared during the deployment phase.

During the windsock folding phase, the lift of the inflated receptacle which is formed by the traction wing 5 in this position is preferably controlled dynamically by the control unit 30, by acting both on the closure lines 13 and on the folding lines 10A, 10B, 10C. The median area 15 of the leading edge 16 is however retained against the stowing mast 4 during the entire windsock folding phase. In a case of this type of dynamic control of the kite folded in the form of a windsock, the closure lines 13 are controlled (drawn or on the contrary released dynamically) such as to obtain an interstitial opening section 16 which is adequate for given wind conditions. For example, the lower the windspeed, the more the trailing edge 17 will be reclosed, in order to provide the traction wing with power, and allow it to stabilize.

Similarly, the folding lines 10A, 10B, 10C can be controlled dynamically by the control unit 30, which controls the movement of the carriages 12B, 12C, 12D in order to open the lateral portions 19 of the leading edge 16 to a greater or lesser extent, according to the conditions. The height of the carriages 12B, 12C, 12D can be adjusted in order to provide the traction wing 5 with the required windsock form, with a smaller or larger opening. The leading edge 16 forms an input, the cross-section of which can be modulated.

Figure 14:
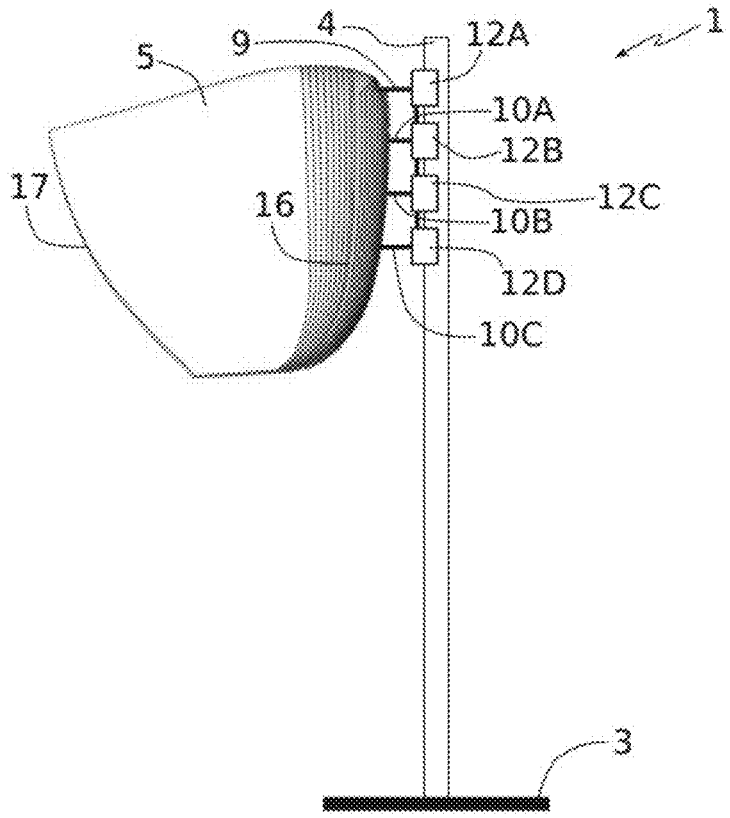
FIG. 14 illustrates another step of the deployment of the traction wing.

After this windsock folding phase, when the traction wing 5 is sufficiently stable and powerful, the traction system goes to a step of opening of the traction wing 5 illustrated in FIG. 14, in which the carriages 12B, 12C, 12D are raised sufficiently to release the folding lines 10A, 10B, 10C completely, such that the traction wing 5 is completely open, although retained by the median area 15 of the leading edge 16 against the stowing mast 4. FIG. 15 illustrates this open position of the traction wing 5 in perspective.

The traction wing 5 is then ready for its flight, and is already exerting a traction force, such that the following step of deployment consists of actuating the winch 11 in order to release the traction line 8, and to release the guide line 9, which gives rise to raising of the traction wing 5 to its flight position. The deployment process is thus completed.

In addition, FIGS. 16 and 17 are partial views of the traction wing 5, and relate to two illustrative variants for the embodiment of the closure lines 13.

According to a first variant illustrated in FIG. 16:

an end of the guide line 9 is secured (for example by being sewn) onto the trailing edge 17 of the traction wing 5;

the different closure lines 13A move on the underneath of the traction wing 5, from their fastening on the trailing edge, and meet in a single closure line 13B.

The single closure line 13B projects from the leading edge 16. In this example, this line 13B exits via a ring 27 which is secured on the traction wing.

The guide line 9 and the single closure line 13B can be grasped independently from one another by carriages on the stowing mast 4, and can be controlled independently from one another. During the windsock folding step, the guide line 9 is thus grasped and drawn against the stowing mast 4, whereas the single closure line 13B is drawn or released during the dynamic control of the kite folded in the form of a windsock, in order to finally to be released completely during the step of opening of the traction wing 5.

For this variant, as for all the embodiments, the guide line 9 can be connected directly to the leading edge 16, as illustrated in FIG. 16, or it can be connected to an intermediate element, which itself is connected by a connection to the leading edge (this connection being able to be a textile connection, a connection plate such as a rib, or any other means for connecting an intermediate element to the leading edge of the traction wing).

FIG. 17 illustrates a second variant of the arrangement of the guide line 9 and of the closure lines. The closure lines 13A meet here at a single point to which the guide line 9 is attached. In other words, the guide line 9 is extended into closure lines 13A. Before its extension into closure lines 13A, the guide line 9 passes through a clamping means 28, which is attached to the traction wing 5 by means of a flexible connection 31 (or which is secured directly on the fabric of the traction wing 5).

In this case, the clamping means 28 comprise jaws 29 which are closable on the guide line 9, in order to secure the guide line relative to the leading edge 16. On the other hand, the jaws 29 can be released (for example by means of an electromechanical command controlled by the control unit 30), and thus permit the free sliding of the guide line 9 in the clamping means 28, such that traction on the guide line 9 gives rise to traction on the closure lines 13.

Before the windsock folding phase, the traction wing 5 is firstly retained against the stowing mast 4 thanks to traction on the guide line 9, while the jaws 29 are closed. During the windsock folding phase, release of the closure lines 13 can take place by opening the jaws 29, and releasing the guide line 9 until the release required for the closure lines 13 is obtained, and the jaws 29 are then closed in order once more to assure the retention of the leading edge 16 against the stowing mast 4.

Figure 18:
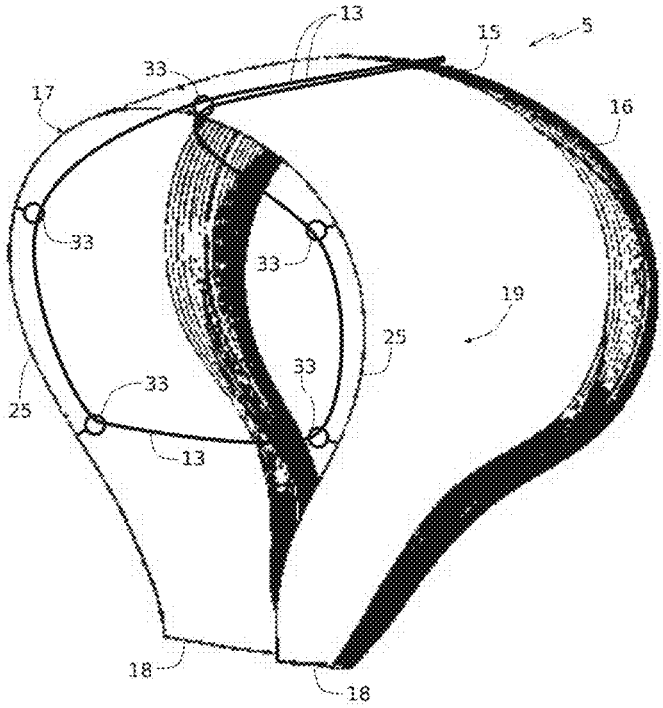
FIG. 18 illustrates an embodiment for movement of the closure line on the trailing edge of the traction wing.
Figure 19:
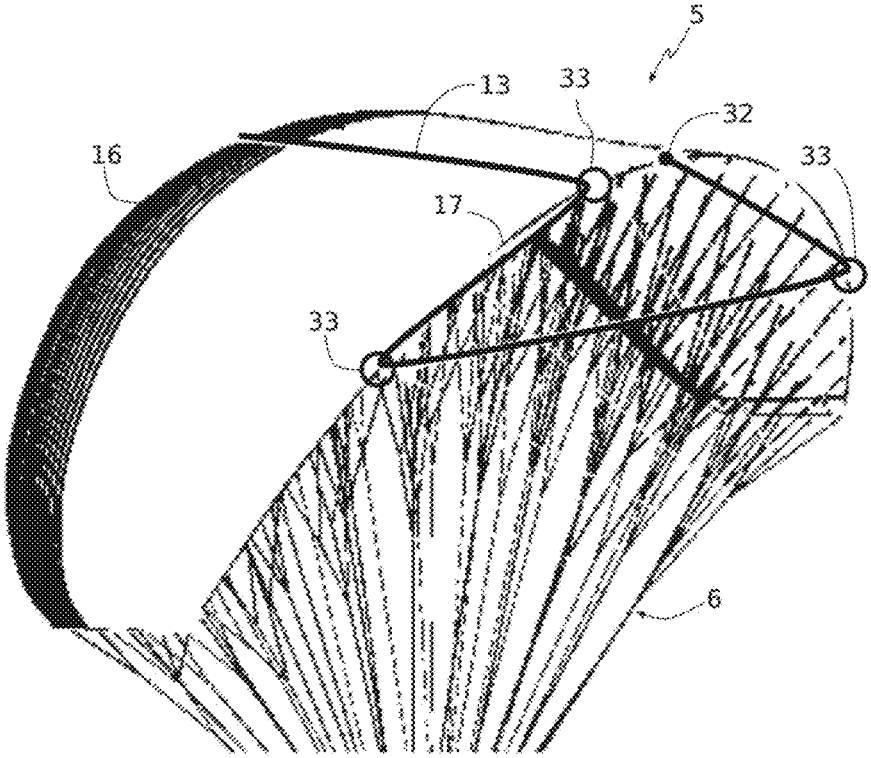
FIG. 19 illustrates another embodiment for movement of the closure line on the trailing edge of the traction wing.

FIGS. 18 and 19 illustrate two embodiments of the arrangement of the closure lines 13 on the trailing edge 17 of the traction wing 5.

With reference to FIG. 18, the closure lines 13 can move relative to the trailing edge 17 thanks to rings 33 which are secured on the traction wing. Alternatively, the rings 33 can be replaced by pulleys, or by any other element which retains the closure lines 13 in a sliding manner. In this example, a single closure line passes doubled through a central ring 33, and forms a loop in relation to the trailing edge. Traction on the two strands of the closure line 13 gives rise to closure of the trailing edge 17, thus permitting the windsock folding previously described.

FIG. 19 gives another example of a simplified arrangement of the closure lines 13. A single closure line 13 passes via three rings 33 positioned on the trailing edge 17. The end of the closure lines 13 is integral with a fixed point 32 on the traction wing 5. Similarly, traction on the closure line gives rise to the windsock folding.

The closure line 13 thus connects the two lateral portions 25 of the trailing edge 17, by forming a loop between two rings 33 each positioned on one of these lateral portions 25. The closure lines 13 acts in the manner of a lasso, thanks to a loop which is designed to reduce the perimeter of the trailing edge 17, making it circular, by means of an action similar to that of a diaphragm.

Variant embodiments of the traction system 1 and its deployment process can be envisaged. In particular, the guide line and the folding and closure lines can vary in their arrangement, geometry and number, in order to assure the windsock folding step described.

In addition, the guide line 9 can fulfil its function of traction on the leading edge of the traction wing in different ways. For example, it can be connected directly to the base platform, rather than to the flying trajectory control device. It can also be connected permanently to a stowing line 20, which would be connected in a sliding manner on this guide line 9.

The windsock folding step can also be implemented during the phase of refolding of the traction wing, in order to provide the traction wing with a certain stability before folding, and guarantee more careful folding.

The movement of the closure line along the traction wing, between its leading edge and its trailing edge, can be arranged differently, while assuring the closure of the trailing edge during the windsock folding step. For example, the closure line can comprise a strand positioned along the trailing edge, i.e. on the periphery constituted by the trailing edge during the windsock folding.

The invention claimed is:

1. A process for deployment of a tethered-wing traction system, the tethered-wing traction system comprising:

a traction wing (5) to generate a traction force under the effect of the wind, and is deployed and refolded relative to a base platform (3) having a stowing mast (4), the traction wing (5) having: a trailing edge (17) which comprises two lateral portions (25); and a leading edge (16) which comprises a median area (15) and two lateral portions (19); the process comprising a step of making the traction wing (5) fly relative to the stowing mast (4), the process comprises, before the flight step, a windsock folding step of the traction wing (5), wherein:

the median area (15) of the leading edge (16) is retained relative to the stowing mast (4) at a first height on the stowing mast (4);

the lateral portions (19) of the leading edge (16) are retained relative to the stowing mast (4) at a second height at least on the stowing mast (4), which is lower than said first height, the leading edge (16) forming a windsock air inlet with a circular opening;

the trailing edge (17) is reclosed by bringing the lateral portions (19) of the trailing edge (17) towards one another.

2. The process as claimed in claim 1, wherein the retention relative to the stowing mast (4) of the median area (15) of the leading edge (16) is provided by traction of a line which is connected to the median area (15) of the leading edge (16).

3. The process as claimed in claim 2, wherein said line which is connected to the median area (15) of the leading edge (16) is connected to the median area (15) by a clamping device (28), and is connected to the closure line (13), with the windsock folding step comprising an operation of release or traction of the closure line (13), the operation comprising the following steps:

opening of the clamping device (28);

release or traction of said closure line (13) which is connected to the median area (15) of the leading edge (16), giving rise to release or traction on the closure line (13);

closure of the clamping device (28).

4. The process as claimed in claim 1, wherein the retention relative to the stowing mast (4) of the lateral portions (19) of the leading edge is provided by traction of folding lines (10A, 10B, 10C) which each have an end secured to the leading edge (16), while being spaced from one another along the leading edge (16).

5. The process as claimed in claim 4, wherein the folding lines (10A, 10B, 10C) are positioned in symmetrical pairs, with each folding line of a pair connecting the median area (15) of the leading edge (16) to another area of the leading edge (16), and in that the traction of the folding lines (10A, 10B, 10C) is provided by pulling jointly on the two lines of each pair of folding lines.

6. The process as claimed in claim 5, wherein the retention relative to the stowing mast (4) of the lateral portions (19) of the leading edge (16) is provided by traction of at least three pairs of symmetrical folding lines (10A, 10B, 10C), following at least three heights along the stowing mast (4).

7. A process for deployment of a tethered-wing traction system, the tethered-wing traction system comprising:

a traction wing (5) to generate a traction force under the effect of the wind, and is deployed and refolded relative to a base platform (3) having a stowing mast (4), the traction wing (5) having: a trailing edge (17) which comprises two lateral portions (25); a leading edge (16) which comprises a median area (15) and two lateral portions (19);

the process comprising a step of making the traction wing (5) fly relative to the stowing mast (4), the process comprises, before the flight step, a windsock folding step of the traction wing (5), wherein:

the median area (15) of the leading edge (16) is retained relative to the stowing mast (4) at a first height on the stowing mast (4);

the lateral portions (19) of the leading edge (16) are retained relative to the stowing mast (4) at a second height at least on the stowing mast (4), which is lower than said first height, the leading edge (16) forming a windsock air inlet with a circular opening;

the trailing edge (17) is reclosed by bringing the lateral portions (19) of the trailing edge (17) towards one another, wherein the closure of the trailing edge (17) is carried out by traction of at least one closure line (13) connected to the trailing edge (17); and wherein during the windsock folding step, the closure line (13) is grasped by a first carriage (12A) sliding along the stowing mast (4).

8. The process as claimed in claim 7, wherein during the windsock folding step, the folding lines (10A, 10B, 10C) are each grasped in a sliding manner by a carriage (12A, 12B, 12C) situated below the first carriage (12A).

9. A tethered-wing traction system, comprising:

a traction wing (5) which is designed to generate a traction force under the effect of the wind, and is designed to be deployed and refolded relative to a base platform (3) which is provided with a stowing mast (4), the traction wing (5) having: a trailing edge (17) which comprises two lateral portions (25); and a leading edge (16) which comprises a median area (15) and two lateral portions (19);

a plurality of folding lines (10A, 10B, 10C) each having a free end secured to the leading edge (16), while being spaced from each other along the leading edge (16);

a line which is connected to the median area (15) of the leading edge (16);

at least one closure line (13) which is connected to the trailing edge (17);

a control unit (30) designed to control traction on the line which is connected to the median area (15), the folding lines (10A, 10B, 10C), and the closure line (13), the control unit (30) comprising a windsock folding mode wherein: the median area (15) of the leading edge (16) is retained relative to the stowing mast (4) at a first height on the stowing mast (4), by traction of the line which is connected to the median area (15); the lateral portions (19) of the leading edge (16) are retained relative to the stowing mast (4) at a second height at least on the stowing mast (4), which is lower than said first height, by traction of the folding lines (10A, 10B, 10C); the trailing edge (17) is reclosed by bringing the lateral portions (19) of the trailing edge (17) towards one another, under the effect of traction of the closure line (13);

wherein the line which is connected to the median area (15) is connected to the median area (15) by a clamping device (28), and is connected to the closure line (13), with the control unit (30) being designed to control the clamping device (28) such that, when it is in its windsock folding mode, the control unit (30) is designed to, in succession:

open the clamping device (28);

release or pull the line which is connected to the median area (15), while giving rise to release or traction on the closure line (13);

close the clamping device (28).

10. The traction system as claimed in claim 9, wherein the folding lines (10A, 10B, 10C) are positioned in symmetrical pairs, with each folding line of a pair connecting the median area (15) of the leading edge (16) to another area of the leading edge (16), and in that the traction of the folding lines (10A, 10B, 10C) is provided by pulling jointly on the two lines of each pair of folding lines.

11. The traction system as claimed in claim 9, further comprising carriages (12A, 12B, 12C, 12D) which slide along the stowing mast (4) and grasp in a sliding manner the line which is connected to the median area (15) and the folding lines (10A, 10B, 10C), these carriages (12A, 12B, 12C, 12D) being spaced from one another along the stowing mast (4) when the control unit (30) is in the windsock folding mode.

12. The traction system as claimed in claim 9, wherein the closure line moves along the trailing edge (17) while passing into rings (33).

13. The traction system as claimed in claim 12, wherein the closure line (13) connects the two lateral portions (25) of the trailing edge (17).

14. The traction system as claimed in claim 13, wherein the closure line (13) forms a loop between two rings (33) each positioned on a lateral portion (25) of the trailing edge (17).

* * * * *